US006296347B1

(12) United States Patent
Shibata

(10) Patent No.: US 6,296,347 B1
(45) Date of Patent: Oct. 2, 2001

(54) DIRECT ELECTROSTATIC RECORDING APPARATUS WITH MODIFIED ELECTRODE SHAPE FOR PREVENTING UNEVEN IMAGE DENSITY

(75) Inventor: Yoshifumi Shibata, Toyokawa (JP)

(73) Assignees: Minolta Co., Ltd., Osaka (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/377,436

(22) Filed: Aug. 19, 1999

(30) Foreign Application Priority Data

Aug. 19, 1998 (JP) ..... 10-232748

(51) Int. Cl.[7] ..... B41J 2/06
(52) U.S. Cl. ..... 347/55
(58) Field of Search ..... 347/15, 20, 54, 347/55; 358/298

(56) References Cited

U.S. PATENT DOCUMENTS 5,477,250 12/1995 Larson ..... 347/55
6,012,801 * 1/2000 Nilsson ..... 347/55
6,074,045 * 6/2000 Bergman et al. ..... 347/55

* cited by examiner

*Primary Examiner*—John Barlow
*Assistant Examiner*—Robert D Loper, Jr.
(74) *Attorney, Agent, or Firm*—Morrison & Foerster LLP

(57) ABSTRACT

A direct recording apparatus of the invention comprises a recording roller 30 for transferring charged toner particles 38, a back electrode 44 opposed to the recording roller 30 to attract the toner particles 38, a PC board 50 disposed between the recording roller 30 and the back electrode 44 to control the toner particles 38 to jump or not to jump toward the back electrode 44. The PC board 50 of the invention is provided with a plurality of apertures 56 through which the toner particles 38 can pass. The periphery of the aperture 56 is provided with an electrode 68 to allow the toner particles 38 on the recording roller 30 to jump depending on electric signals. The electrode 68 has a shape wherein a part of a ring shape surrounding the aperture 56 is cut off in a direction of a rotation axis of the recording roller 30. This configuration can eliminate unevenness in image density without rotating the recording roller at high speed.

3 Claims, 5 Drawing Sheets

DIRECT ELECTROSTATIC RECORDING APPARATUS WITH MODIFIED ELECTRODE SHAPE FOR PREVENTING UNEVEN IMAGE DENSITY

RELATED APPLICATION

This application is based on Japanese Patent Application No.10-232748, the content of which is incorporated herein by reference.

BACKGROUND OF THE INVENTION

1. Field of the Invention

The present invention relates to an apparatus for recording images on a recording sheet, such as paper, by allowing recording particles to jump and directly attach to the recording sheet.

2. Description of the Related Art

The U.S. Pat. No. 5,477,250 issued on Dec. 19, 1995 discloses a recording apparatus. This recording apparatus comprises a cylindrical toner retaining member, which is rotatable, for retaining charged toner particles (recording particles) on its outer peripheral surface, and a back electrode spaced from the toner retaining member. The back electrode is electrically connected to a power source, and an electric field is formed to attract the charged toner particles on the toner retaining member toward the back electrode. An insulating plate provided with a plurality of apertures, through which the toner particles can pass, is disposed between the toner retaining member and the back electrode. In addition, the insulating plate is provided with a ring-shaped electrode surrounding each of the apertures.

In the above-mentioned recording apparatus, when a signal corresponding to image data is applied to the electrode, the toner particles existing in a position on the toner retaining member opposed to the electrode separate and jump into the corresponding aperture. After passing through this aperture, the toner particles attach to a recording sheet, and an image corresponding to the image data is recorded on the recording sheet.

In the above-mentioned recording apparatus, however, the plurality of apertures in the insulating plate are slightly shifted from one another in the rotation direction of the toner retaining member in some cases in order to raise resolution. In such cases, when two apertures adjacent to each other are viewed in the rotation direction of the toner retaining member, if the ring-shaped electrodes formed around each aperture are positioned so as to overlap with each other although the two ring-shaped electrodes do not make contact with each other, an area on the toner retaining member, wherein the toner particles jumping to one of the apertures located on the upstream side in the rotation direction of the toner retaining member have been retained, may partially overlap with an area on the toner retaining member, wherein the toner particles jumping to the other aperture located on the downstream side thereof. As a result, the amount of the toner particles passing through the other aperture located on the downstream side is less than the amount of the toner particles passing through the aperture located on the upstream side. Consequently, streak-like unevenness in image density may occur on an image to be formed.

To eliminate such unevenness in density, a measure of rotating the toner retaining member at high speed can be used. However, this measure is not desirable since the toner particles become heated, thereby causing another problem of fusing and adhering of the toner particles on the toner retaining member.

SUMMARY OF THE INVENTION

Accordingly, an object of the present invention is to provide a direct recording apparatus capable of eliminating unevenness in image density without rotating the toner retaining member at high speed, and to provide a PC board used for the recording apparatus.

In order to attain the above-mentioned object, a PC board of the present invention is used for a direct recording apparatus provided with:

transfer means for retaining charged recording particles and transferring the recording particles in a predetermined direction;

a back electrode provided as opposed to the transfer means to electrically attract the recording particles; and the PC board provided between the transfer means and the back electrode to control the recording particles to jump or not to jump toward the back electrode, and the PC board comprises:

a first aperture formed in the PC board;

a second aperture formed in the PC board on the downstream side in the predetermined direction and at a position shifted with respect to the first aperture in the direction perpendicular to the predetermined direction;

a first electrode provided corresponding to the first aperture to control the recording particles to jump from the transfer means toward the back electrode through the first aperture depending on an electric signal supplied from an external power source;

a second electrode provided corresponding to the second aperture to control the recording particles to jump from the transfer means toward the back electrode through the second aperture depending on an electric signal supplied from the external power source; wherein each of the first and second electrodes has a shape wherein a part of a ring shape surrounding the aperture is cut off in the perpendicular direction.

In accordance with the PC board of the present invention, the first electrode may not overlap with the second electrode in the perpendicular direction at all.

Furthermore, the PC board of the present invention may comprise:

a third electrode provided corresponding to the first aperture and formed on the side of the back electrode with respect to the first electrode; and a fourth electrode provided corresponding to the second aperture and formed on the side of the back electrode with respect to the second electrode.

Furthermore, the direct recording apparatus of the present invention comprises:

transfer means for retaining charged recording particles and transferring the recording particles in a predetermined direction;

a back electrode provided as opposed to the transfer means to electrically attract the recording particles; and the PC board in accordance with the present invention, provided between the transfer means and the back electrode.

In the PC board or the direct recording apparatus of the present invention, each of the first and second electrodes has a shape wherein a part of a ring shape surrounding the aperture is cut off in the perpendicular direction. When the first electrode receives the electric signal from the external power source and allows the recording particles to jump through the first aperture, a width of a first area of the recording particles to be separated from the transfer means becomes smaller in the perpendicular direction than a width in the case that the first electrode is ring-shaped. In the same way, when the second electrode receives the electric signal from the external power source and allows the recording particles to jump through the second aperture, a width of a second area of the recording particles to be separated from the transfer means also becomes smaller in the perpendicular direction than a width in the case that the second electrode is ring-shaped. Therefore, even when the recording particles are allowed to jump through the second aperture, immediately after the recording particles are allowed to jump through the first aperture, the second area on the transfer means hardly overlaps with the first area thereon. As a result, the amount of the recording particles jumping through the second aperture is not much different from the amount of the recording particles jumping through the first aperture. Consequently, unevenness in image density can be reduced or eliminated substantially.

Furthermore, by disposing the first electrode so as not to overlap with the second electrode in the perpendicular direction, the first separation area corresponding to the first aperture does not overlap with the second separation area corresponding to the second aperture at all. Therefore, the amounts of the recording particles jumping through each of the first and second apertures are made uniform. As a result, the effect of eliminating unevenness in image density can be made more securely.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

Figure 1:
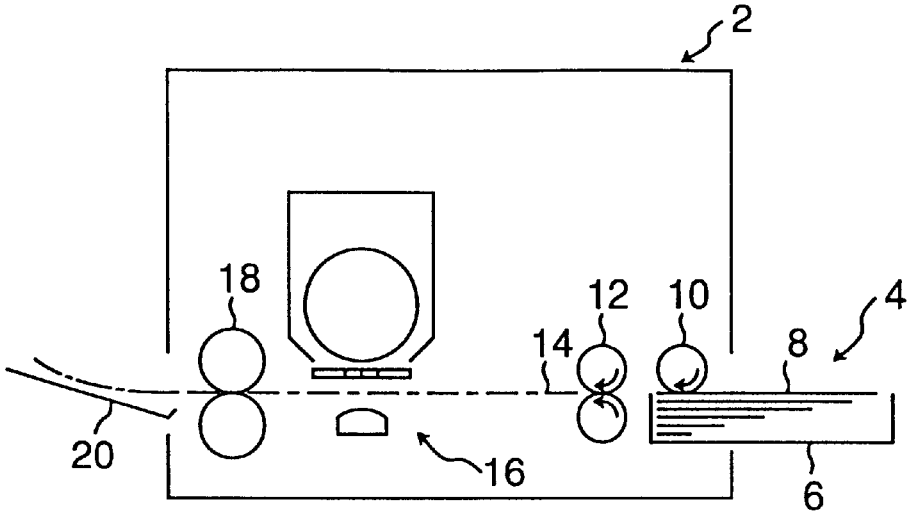
FIG. 1 is a schematic sectional view showing a direct recording apparatus in accordance with the present invention.

Referring to FIG. 1, a reference numeral 2 designates a whole structure of a direct recording apparatus in accordance with the present invention. The recording apparatus 2 has a sheet supply station, the whole structure of which is designated by a reference numeral 4. The sheet supply station 4 is removably provided with a cassette 6, in which sheets 8 of paper or the like are stacked and accommodated. A sheet supply roller 10 is disposed above the cassette 6, and rotates while making contact with the uppermost sheet 8 to feed this sheet 8 into the recording apparatus 2. Near the sheet supply roller 10, a pair of timing rollers 12 is disposed to supply the sheet 8 fed from the cassette 6 along a sheet passage 14 indicated by a chain line to a recording station (the whole structure is designated by a reference numeral 16) in which a image made of recording particles is formed on the sheet 8. Furthermore, the recording apparatus 2 has a fixing station 18 for permanently fixing the image formed of the recording particles, and a final stack station 20 for accommodating the sheet 8 on which the image formed of the recording particles is fixed.

Figure 2:
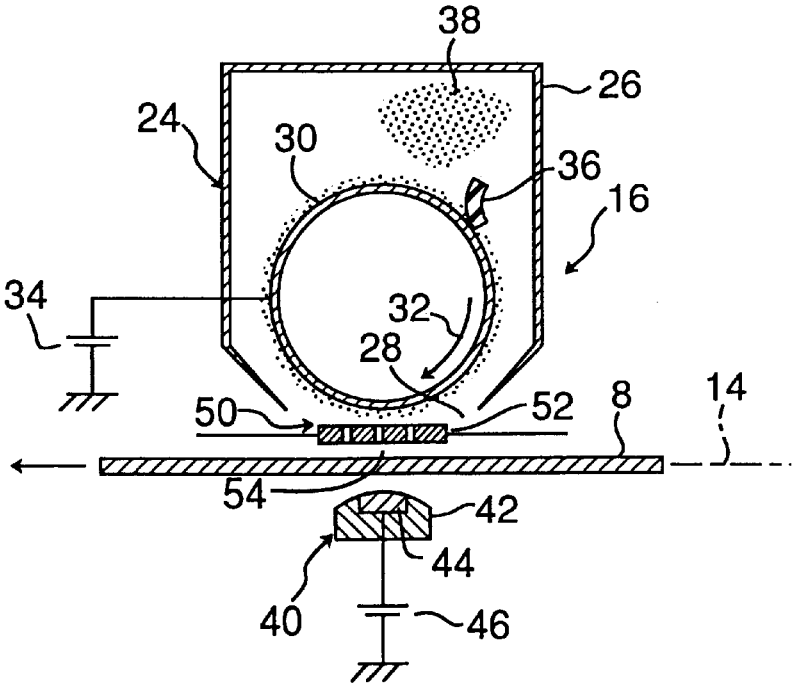
FIG. 2 is a schematic sectional view showing a recording station.

Referring to FIG. 2, the recording station 16 has a recording particle supply portion, the whole structure of which is designated by a reference numeral 24, above the sheet passage 14. This recording particle supply portion 24 has a container 26. This container 26 is provided with an opening 28 opposed to the sheet passage 14. Near the opening 28, a recording roller (a retaining member) 30 is supported rotatably in the direction indicated by an arrow 32. The recording roller 30 is made of a conductive material and electrically grounded via a DC power source 34. A blade 36 which is formed of a plate preferably made of rubber or stainless steel is disposed so as to make contact with the recording roller 30. The recording roller 30 may be directly grounded, instead of being grounded via the DC power source 34.

The container 26 accommodates recording particles, i.e., toner particles 38. The toner particles 38 are supplied to the outer peripheral surface of the recording roller 30 by a supply means, i.e., a supply roller (not shown), accommodated in the container 26 to be transferred in accordance with the rotation of the recording roller 30. Afterwards, the toner particles 38 retained on the recording roller 30 are fed to an area where the recording roller 30 makes contact with the blade 36. In this area, the toner particles 38 are charged to have a predetermined polarity by frictional contact with the blade 36. In the present embodiment, the toner particles 38 that are charged negatively are used. As a result, the outer peripheral surface of the recording roller 30, having passed the area where the recording roller 30, makes contact with the blade 36 and retains a thin layer of the toner particles 38 charged negatively. In addition, a positive voltage is supplied from the power source 34 to the recording roller 30 as shown in FIG. 2. With this structure, the negatively charged toner particles 38 are electrically attracted by the recording roller 30. In the case that the recording roller 30 is grounded directly, the toner particles 38 are retained on the record recording roller 30 by image force.

An electrode device, the whole structure of which is designated by a reference numeral 40, is disposed under the recording particle supply portion 24 beyond the sheet passage 14. This electrode device 40 has a support 42 made of an insulating material, and aback electrode 44 made of a conductive material. The back electrode 44 is connected to a power source 46, from which a voltage having a predetermined polarity (a positive polarity in the case of the present embodiment) is supplied thereto, whereby the negatively charged toner particles on the recording roller 30 are electrically attracted by the back electrode 44. The level of the voltage to be applied from the power source 46 to the back electrode 44 is set so that the electric field formed between the back electrode 44 and the recording roller 30 by the application of the voltage is not strong enough to allow the toner particles 38 to jump.

Figure 3:
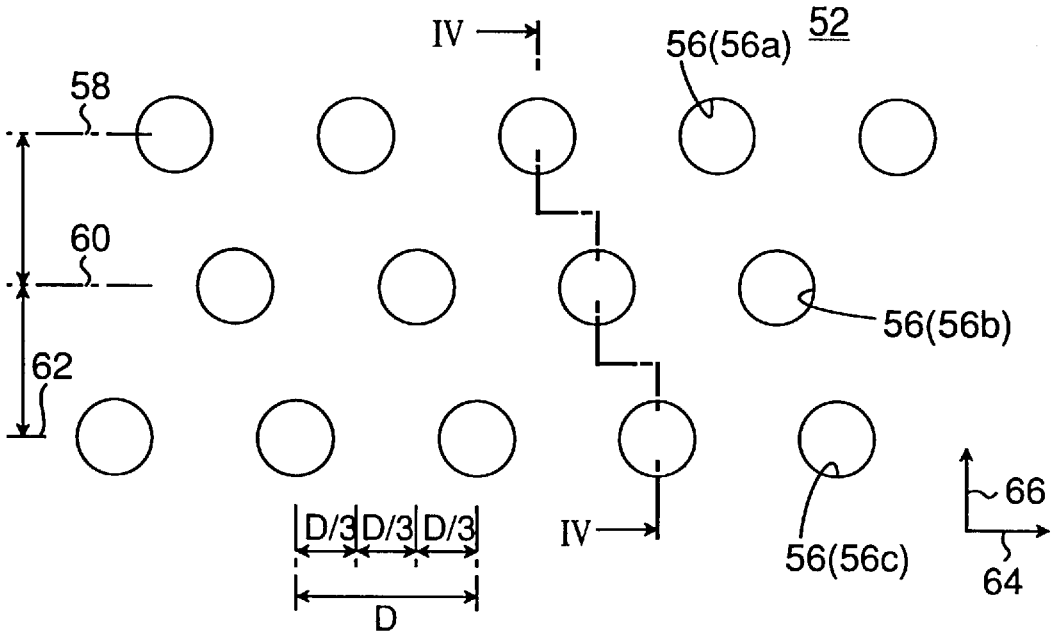
FIG. 3 is a partially enlarged plan view showing a PC board.

A PC board, the whole structure of which is designated by reference numeral 50, is secured between the recording particle supply portion 24 and the electrode device 40 and above the sheet passage 14. The PC board 50 should preferably be formed of a flexible printed circuit board 52 having a thickness of about 100 μm to 200 μm. As shown in FIGS. 2 and 3, the portion of the PC board 50, positioned at a recording area 54 wherein the recording roller 30 is opposed to the back electrode 44, is provided with a plurality of apertures 56 having an inner diameter of about 25 μm to 200 μm, substantially larger than the average grain diameter (about 5 μm to about 15 μm) of the toner particles 38.

As shown in FIG. 3, in the present embodiment, the apertures 56 are provided in three rows on evenly spaced parallel lines 58, 60 and 62 extending in the direction indicated by the arrow 64 (in the direction parallel to the rotation axis of the recording roller 30 and perpendicular to the rotation direction of the recording roller 30, that is, to the transfer direction of the toner particles, this definition being applicable to the following descriptions), whereby the PC board 50 has a resolution of 600 dpi. The apertures 56 on the lines 58, 60 and 62 are evenly spaced at intervals of distance D (127 μm in the present embodiment). The aperture 56 (56*a*) on the third line, i.e., the line 58, and the aperture 56 (56*c*) on the first line, i.e., the line 62, are shifted from the aperture 56 (56*b*) on the second line, i.e., the line 60, by a distance (D/n) (n: the number of lines, 3 in the present embodiment) in opposite directions, respectively. As a result, as viewed in the sheet feeding direction 66, all the apertures 56 can be seen as disposed at equal intervals (D/3) on the whole. The distanceD and the number of lines n can be set appropriately depending on the resolution.

Figure 4:
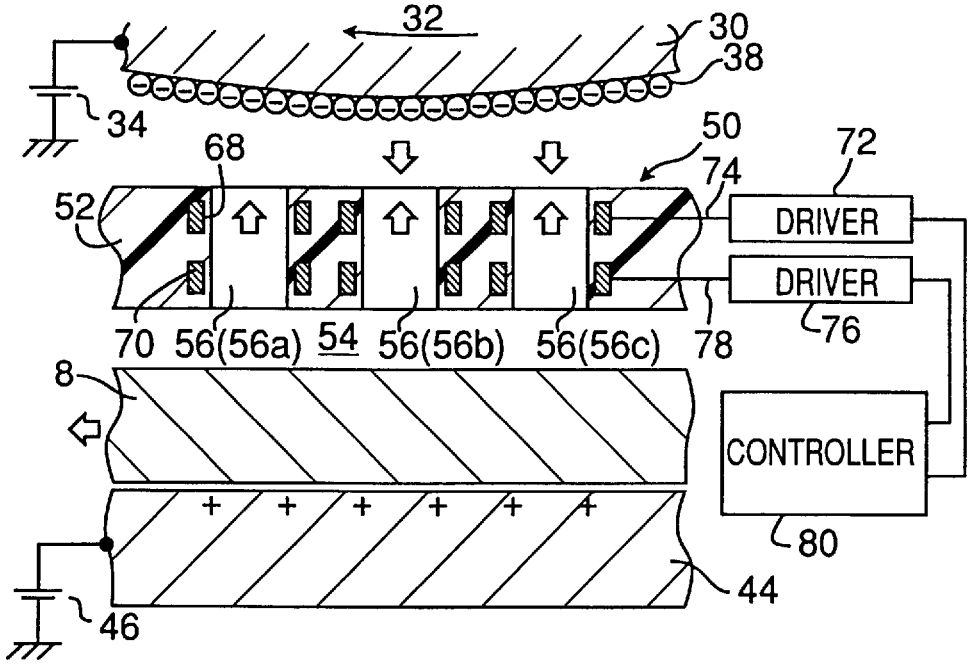
FIG. 4 is a partially enlarged sectional view showing the PC board, a recording roller and a back electrode, taken on line IV—IV of FIG. 3, at the time when a thin layer of toner particles is retained on the recording roller.
Figure 5:
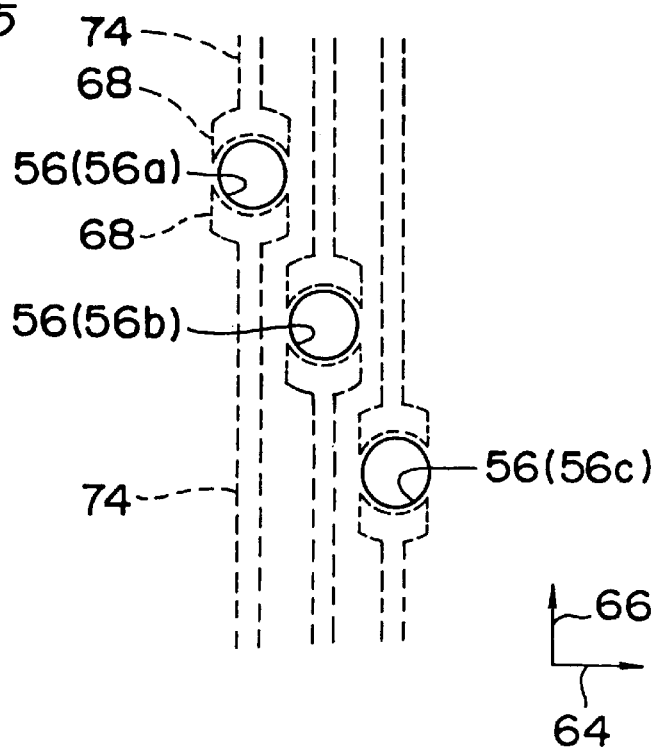
FIG. 5 is a partially enlarged view showing the shape of an upper electrode by broken lines.
Figure 6:
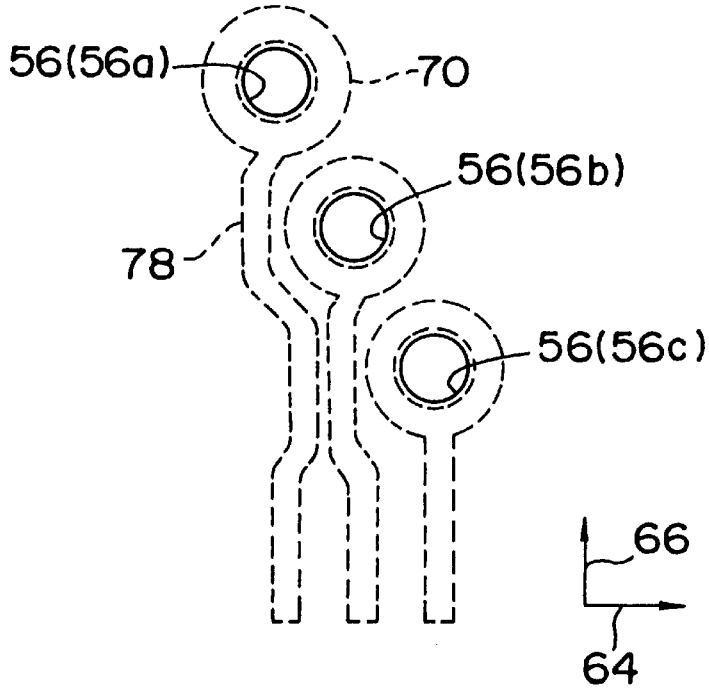
FIG. 6 is a partially enlarged view showing the shape of a lower electrode by broken lines.

As shown in FIG. 4, the flexible printed circuit board 52 is provided with a upper electrode 68 and a lower electrode 70 around each aperture 56. The upper electrode 68 is disposed near the surface of the board 52 which is opposed to the recording roller 30, and the lower electrode 70 is disposed nearer to the back electrode 44 than the upper electrode 68. As shown in FIG. 5, the upper electrode 68 has a shape wherein both side portions of a circular ring shape surrounding the aperture 56 is cut off in the direction indicated by the arrow 64. Therefore, the width of the upper electrode 68 is smaller than that of a circular ring-shaped electrode in the direction indicated by the arrow 64. By forming the upper electrodes as described above, the upper electrode 68 for the aperture 56*a* slightly overlaps with the upper electrode 68 for the aperture 56*b* adjacent to the aperture 56*a* as viewed in the direction indicated by the arrow 66. This relationship is applicable in the same way to the upper electrode 68 for the aperture 56*b* and the upper electrode 68 for the aperture 56*c*. The two portions of the upper electrode 68 opposed to each other in the direction indicated by the arrow 66 are electrically connected to a first driver (an external power source) 72 via printed wires 74, respectively. on the other hand, as shown in FIG. 6, the lower electrode 70 is formed in a circular ring so as to surround the aperture 56 and electrically connected to a second driver 76 via a printed wire 78. As a result, electric signals depending on image data are sent to the upper electrodes 68 and the lower electrodes 70 from the first driver 72 and the second driver 76, respectively. In addition, the first driver 72 and the second driver 76 are electrically connected to a controller 80 for outputting the data of the image to be formed by the recording apparatus 2.

Next, the operation of the recording apparatus 2 will be described below. The recording roller 30 rotates in the direction indicated by the arrow 32 as shown in FIG. 2. The toner particles 38 are supplied to the recording roller 30 and fed to the area wherein the blade 36 and the recording roller 30 make contact with each other. At this area, the toner particles 38 are negatively charged by the friction with the blade 36. Consequently, the outer peripheral portion of the recording roller 30, having passed through the above-mentioned contact area, retains the thin layer of the charged toner particles 38 as shown in FIG. 4.

In the PC board 50, at the time of non-recording, a base voltage of, for example, about −50 V is applied to the upper electrode 68, and a base voltage of, for example, about −100 V is applied to the lower electrode 70. For this reason, the negatively charged toner particles 38 on the recording roller 30 are electrically repelled by the upper electrode 68 and the lower electrode 70, and remain retained stably on the recording roller 30, without jumping toward the aperture 56.

The controller 80 outputs image data corresponding to an image to be reproduced to the first driver 72 and the second driver 76. In response to the image data, the first driver 72 applies a pulse voltage of, for example, about 300 V to the upper electrode 68, and the second driver 76 applies a pulse voltage of, for example, about 200 V to the lower electrode 70 used as a pair with the upper electrode 68. As a result, the toner particles 38 retained at the portion of the recording roller 30, opposed to the electrodes to which the pulse voltages are applied, are electrically attracted more strongly, mainly by the upper electrode 68. Consequently, numerous toner particles 38 separate from the recording roller 30, and jump toward the opposed aperture 56 by virtue of the attraction force of the back electrode 44.

It is herein supposed that, immediately after the toner particles 38 are allowed to jump into the aperture 56*c* located on the first line and on the upstream side in the rotation direction of the recording roller 30, the toner particles 38 are allowed to jump into the aperture 56*b* adjacent to the aperture 56*c* and located on the second line and on the downstream side thereof. First, the pulse voltage is applied to the upper electrode 68 for the aperture 56*c*. The toner particles 38 retained on the recording roller 30 are attracted and separated, and jump toward the aperture 56*c*. At this time, the toner particles 38 on the recording roller 30 are electrically attracted mainly by the upper electrode 68, and separate from the recording roller 30. Therefore, the area of the separation is nearly equal to the size of the upper electrode 68. When this separation area moved close to the aperture 56*b* in accordance with the rotation of the recording roller 30, the pulse voltage is applied to the upper electrode 68 for the aperture 56*b*, and the toner particles 38 retained at the portion adjacent to the separation area separate and jump. However, the widths of the upper electrodes 68 for the apertures 56*c* and 56*b* in the direction indicated by the arrow 64 are made small so that the upper electrodes slightly overlap with each other as viewed in the direction indicated by the arrow 66. Therefore, the separation area on the record roller 30, wherein the toner particles 38 jumping into the aperture 56*b* have been retained, hardly overlaps with the separation area on the recording roller 30, wherein the toner particles 38 jumping into the aperture 56*c* have been retained. For this reason, the amount of the toner particles 38 jumping into the aperture 56*b* is almost the same as that of the toner particles 38 jumping into the aperture 56*c*. This also is applicable to the aperture 56*a* on the third line located on the further downstream side. Therefore, almost the same amount of the toner particles 38 can be allowed to jump into all the apertures 56.

When the toner particles 38 jumping from the recording roller 30 are passing through the aperture 56, the voltages applied to the upper electrode 68 and the lower electrode 70 are changed to the above-mentioned base voltages corresponding thereto, respectively. As a result, the toner particles 38 passing through the aperture 56 are biased inwardly in the radial direction from the surrounding by the upper electrode 68 and the lower electrode 70, to which the base voltages (−50 V and −100 V) are applied, respectively, and the toner particles 38 converge. The group of the toner particles 38 having converged attaches to the sheet 8 fed from the sheet supply station 4 to the recording area 54, thereby forming a dot on the sheet 8. The dot formed in this way by the toner particles 38 having converged can have a clear outline and high density on the sheet 8. When the voltage applied to the upper electrode 68 is changed from the pulse voltage to the base voltage, the toner particles 38 stop jumping from the recording roller 30.

The sheet 8 to which the toner particles 38 have attached is fed to the fixing station 18. At this station, the toner particles 38 are heated and permanently fixed to the sheet 8. In the end, the sheet 8 is ejected on the stack station 20.

As described above, in the direct recording apparatus 2 of the present embodiment, the width of the upper electrode 68 in the direction parallel to the rotation axis of the recording roller 30 is made small. Therefore, the toner particle separation area on the recording roller 30, corresponding to a specific aperture 56 hardly overlaps with the toner particle separation area on the recording roller 30, corresponding to the aperture 56 adjacent to the specific aperture 56 on the downstream side in the rotation direction of the recording roller 30. For this reason, almost the same amount of the toner particles can jump into all the apertures 56, and dots having the same density can be formed, whereby unevenness in image density can be reduced or eliminated substantially. As a result, the recording roller 30 may rotate at low speed, and is not required to rotate at high speed. For this reason, a compact, inexpensive drive device can be used to drive the recording roller 30. In addition, stresses between the toner particles 38 and the recording roller 30 can be reduced. Consequently, stable image recording can be continued for extended periods of time, and the service life of the recording apparatus can be extended.

Figure 7:
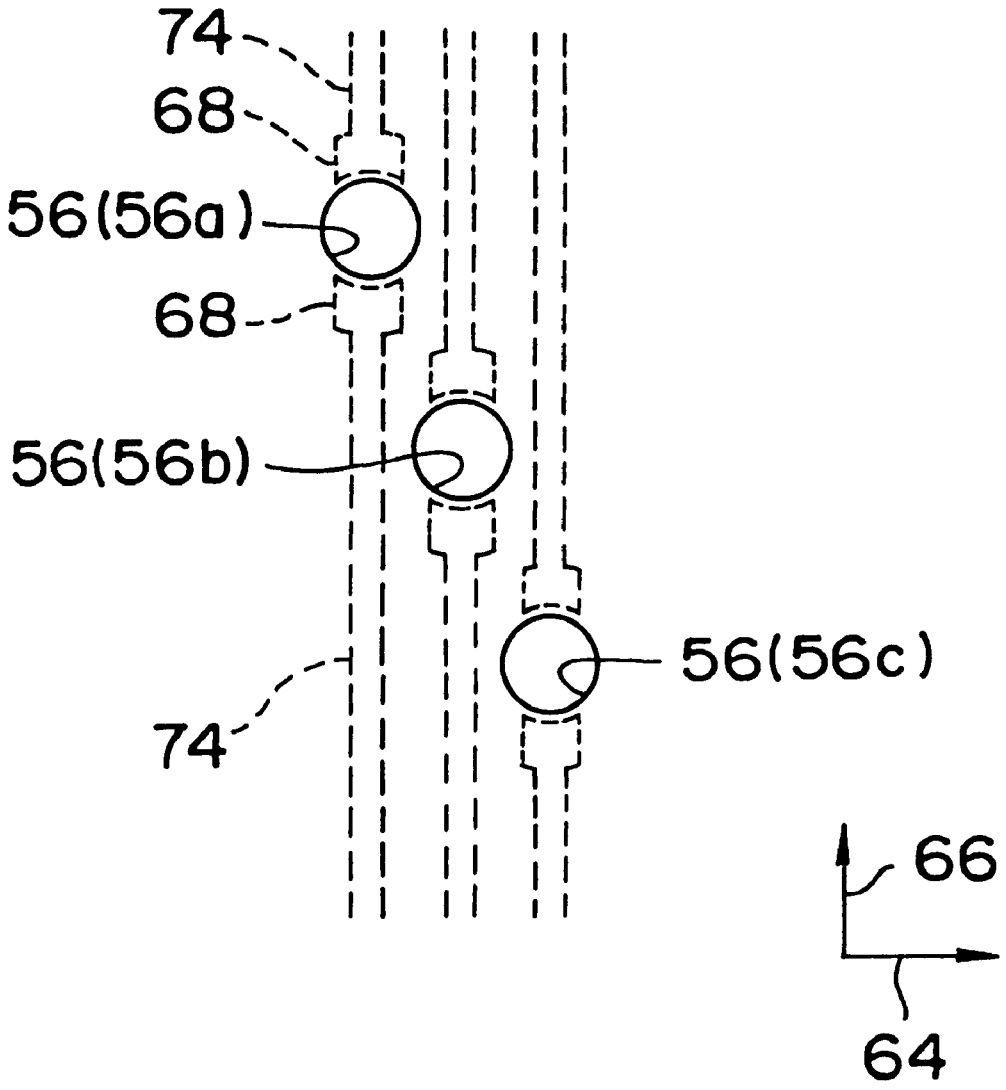
FIG. 7 is a partially enlarged view showing an example of a modified shape of the upper electrode.

In the above-mentioned recording apparatus 2, the widths of the upper electrodes 68 are made small to the extent that a slight overlap remains among them in the direction indicated by the arrow 64. However, when the widths of the upper electrodes 68 for the apertures (56*c*, 56*b* and 56*a*) adjacent to one another on the first, second and third lines are made small so that they do not overlap with one another at all as viewed in the direction indicated by the arrow 66, as shown in FIG. 7, the above-mentioned effect of eliminating unevenness in image density can be attained more securely. In the case that the upper electrodes 68 are formed in this way, even if the apertures 56 are arranged side by side on one straight line, the upper electrodes 68 for the apertures 56 adjacent to one another do not make contact with one another. It is therefore possible to form numerous apertures 56 at a high density in the PC board 50 on only one line.

Figure 8A:
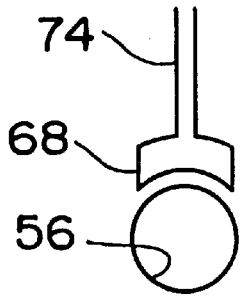
FIGS. 8A to 8E are partially enlarged views showing various examples of modified shapes of the upper electrode.
Figure 8B:
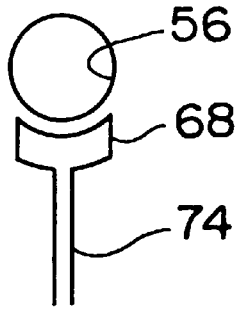
Figure 8C:
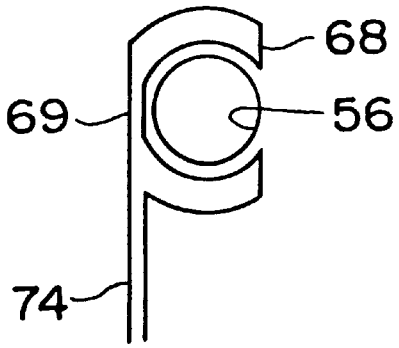
Figure 8D:
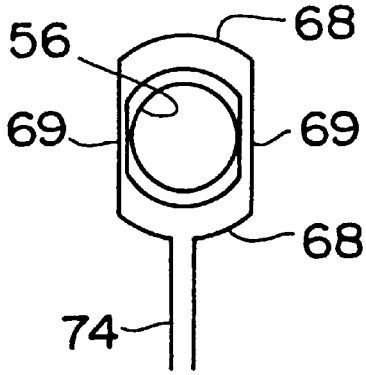
Figure 8E:
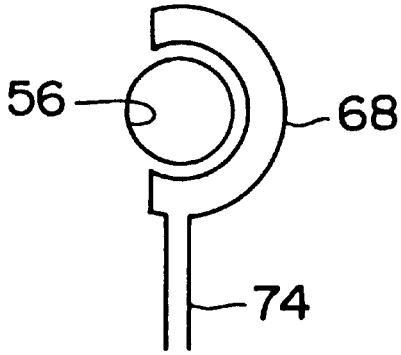
Figure 8E:
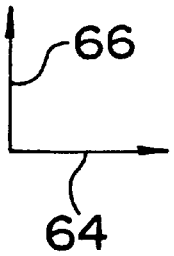

Furthermore, the upper electrode 68 can have various shapes such as, for example, those shown in FIGS. 8A to 8E. FIGS. 8A and 8B show examples wherein the upper electrode 68 is provided only on one side of the aperture 56 in the direction indicated by the arrow 66. Moreover, FIGS. 8C and 8D show examples wherein the two upper electrodes 68, disposed on both sides of the aperture 56 in the direction indicated by the arrow 66, are connected to each other by one or two thin conductive wires 69 to take out the printed wire 74 from one side of the PC board 50. In addition, FIG. 8E shows an example wherein the upper electrode 68 has a shape wherein one side end of a circular ring-shaped electrode is cut off. In these examples, the first electrode 68 may not be symmetrical with respect to a line passing through the center of the aperture 56 and being parallel with the direction indicated by the arrow 66.

The recording particle supply portion is not limited to the above-mentioned type. Any types of developing devices used for electrophotographic image forming apparatuses can be used instead of the recording particle supply portion.

In addition, the back electrode is not limited to the above-mentioned type, but may be a roller made of a conductive material.

Furthermore, the PC board is not limited to the above-mentioned type having apertures arranged in three lines, but may be a PC board having apertures arranged in two lines or more than four lines.

Moreover, although the recording apparatus 2 is provided with the lower electrode 70 so that the jumping toner particles converge inside the aperture 56 in the PC board 50, the present invention is also applicable to a recording apparatus provided with only the upper electrode 68 without being provided with the lower electrode.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included thereto.

What is claimed is:

1. A PC board used for a direct recording apparatus comprising transfer means for retaining charged recording particles and transferring said recording particles in a predetermined direction and a back electrode opposed to said transfer means to electrically attract said recording particles;

said PC board comprising:

a first aperture formed in said PC board;

a second aperture formed in said PC board on a downstream side from said first aperture in said predetermined direction and at a position shifted with respect to said first aperture in a direction perpendicular to said predetermined direction;

a first electrode corresponding to said first aperture to control said recording particles to jump from said transfer means toward said back electrode through said first aperture depending on an electric signal supplied from an external power source;

a second electrode corresponding to said second aperture to control said recording particles to jump from said transfer means toward said back electrode through said second aperture depending on an electric signal supplied from said external power source;

wherein each of said first and second electrodes has a shape wherein a part of a ring shape surrounding said aperture is cut off in said perpendicular direction, and wherein said first electrode does not overlap with said second electrode in said perpendicular direction, said PC board being provided between said transfer means and said back electrode to control said recording particles to jump or not to jump toward said back electrode.

2. A PC board in accordance with claim 1, further comprising:

a third electrode corresponding to said first aperture and formed nearer to said back electrode than to said first electrode; and a fourth electrode corresponding to said second aperture and formed nearer to said back electrode than to said second electrode.

3. A direct recording apparatus comprising:

transfer means for retaining charged recording particles and transferring said recording particles in a predetermined direction;

a back electrode opposed to said transfer means to electrically attract said recording particles; and a PC board in accordance with claim 1 or 2, provided between said transfer means and said back electrode.

* * * * *